US006573834B1

(12) United States Patent
Grimani et al.

(10) Patent No.: US 6,573,834 B1
(45) Date of Patent: Jun. 3, 2003

(54) APPARATUS FOR LOCATING SKIS BENEATH SNOW

(75) Inventors: Anthony Grimani, Fairfax, CA (US); John McKeown, Tahoe City, CA (US)

(73) Assignee: Performance Media Industries, Ltd., Fairfax, CA (US)

( * ) Notice: Subject to any disclaimer, the term of this patent is extended or adjusted under 35 U.S.C. 154(b) by 0 days.

(21) Appl. No.: 10/069,325

(22) PCT Filed: Aug. 18, 2000

(86) PCT No.: PCT/US00/40688

§ 371 (c)(1),
(2), (4) Date: Feb. 19, 2002

(87) PCT Pub. No.: WO01/13137

PCT Pub. Date: Feb. 22, 2001

Related U.S. Application Data

(60) Provisional application No. 60/149,652, filed on Aug. 18, 1999.

(51) Int. Cl.[7] ..... G08B 23/00

(52) U.S. Cl. ..... 340/573.1; 340/568.6; 340/572.1; 340/572.8; 340/825.36; 340/825.49

(58) Field of Search ..... 340/568.6, 573.1, 340/572.1, 572.8, 825.36, 825.49

(56) References Cited

U.S. PATENT DOCUMENTS 4,603,328 A * 7/1986 Larson ..... 340/666
5,260,689 A * 11/1993 Meyers et al. ..... 340/571
6,275,153 B1 * 8/2001 Brooks ..... 340/568.6

* cited by examiner

*Primary Examiner*—Daryl Pope
(74) *Attorney, Agent, or Firm*—Larry D. Johnson; Craig M. Stainbrook; Johnson & Stainbrook, LLP

(57) ABSTRACT

A system to assist a skier in locating an unattached ski in powder snow after a fall includes an audible alarm member which is mounted on the ski, and a remote hand-held activator member held by the skier. The skier can trigger the alarm by operating a switch on the remote activator. The sound emitted by the alarm will allow the skier to locate the direction and position of the lost ski.

18 Claims, 4 Drawing Sheets

FRONT BINDING PLACEMENT

REAR BINDING PLACEMENT

APPARATUS FOR LOCATING SKIS BENEATH SNOW

This application claims the benefit of Provisional application Ser. No. 60/149,652, filed Aug. 18, 1999.

TECHNICAL FIELD

This invention relates generally to sports equipment and associated hardware, and more specifically to an improved apparatus for locating a snow ski that has become detached from a skier's ski boot and is buried in snow or otherwise not visible to the skier.

BACKGROUND ART

Snow skiing, and particularly downhill or "alpine" skiing, is a popular sport. When a snow skier falls and any stress (above an adjustable, predetermined level) is applied to the boot-to-ski binding system, the bindings are designed to release so that the ski and binding detach from the boot. This avoids injury to the skier by preventing excessive torque to the skier's leg. Under normal groomed snow conditions a ski braking system engages upon release of the binding, and the ski comes to a stop. It is relatively easy for the skier to then recover the ski and reattach it to the ski boot.

Under conditions of un-groomed powder snow, after release of the safety binding system (and when retainer straps are not used by the skier), the ski will typically sink down into the powder snow, and it can be difficult or impossible for the skier to find the lost ski. Skiers usually poke through the snow with a ski pole hoping to strike the ski to locate and recover it. This exercise can be difficult and very time-consuming, since the skier has no information on the general location of the ski.

Numerous devices have been developed in an effort to aid the skier in locating such a displaced ski. For example, Petaja U.S. Pat. No. 4,279,433 discloses an emergency locator beacon for skis utilizing a strobe light activated by a trigger mechanism operative to sense the separation of the ski equipment from the user. Yeski U.S. Pat. No. 4,535,322 teaches a runaway ski locator which activates an audible signaling device when a cable is disconnected (as by the release of the ski). Pruett U.S. Pat. No. 4,835,523 teaches a ski beeper which is automatically activated when the ski boot releases from the binding and ski. Rowan et al. U.S. Pat. No. 5,235,331 discloses a ski alarm system which energizes an audible alarm in response to the output from a movement detector on the indication of absence of movement for a predetermined time. Meyers et al. U.S. Pat. No. 5,260,689 teaches a ski alarm apparatus with a separation detect mode in which an alarm is triggered by the disconnection of a tether cord. However, these known devices are believed to be impractical in use, or exhibit significant power consumption resulting in short battery life.

DISCLOSURE OF INVENTION

The apparatus for locating skis beneath snow of this invention provides an improved system to assist a skier in locating an unattached ski in powder snow after a fall. The inventive apparatus includes an audible alarm member which is placed on the ski, preferably releasably, and a remote hand-held trigger or activator member held by the skier. The skier can trigger the alarm member by operating a switch on the remote activator member. The sound emitted by the alarm will allow the skier to locate the direction and position of the lost ski after a fall.

The remote activator member preferably includes a two-channel transmitter. The transmitter is preferably small in size, capable of being handheld, and should include two buttons (or a single multiposition button). The audible alarm member preferably consists of a receiver, a signal generator and an electro-acoustic transducer. Each alarm member is attached to its respective ski, either releasably or permanently, though preferably the former, and is so attached to be in front of or behind the ski binding area. Alternatively, each alarm member may be incorporated into the binding assembly itself, either in the toe member or heel member of the binding system. Each alarm member (i.e., one on the left ski and one on the right ski) is responsive to only one of the two buttons on the transmitter. The remote trigger transmits an RF or other suitable triggering signal to the alarm member receivers. The activated alarm member emits a loud sound signal, per the electro-acoustic specifications.

The ski finder of this invention thus provides a practical and efficient means to detect the general location of the lost ski in order to speed the search.

BEST MODE FOR CARRYING OUT THE INVENTION

Figure 1:
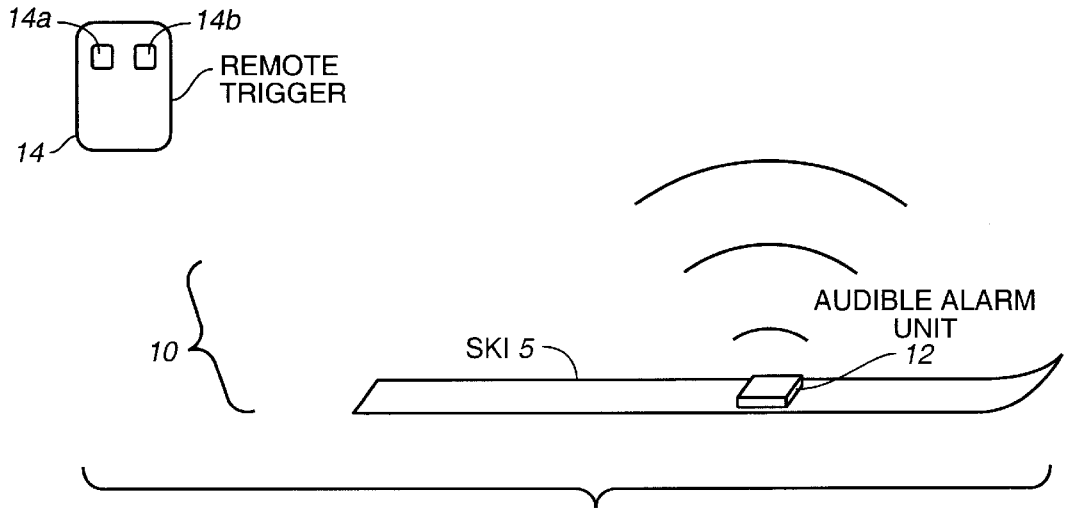
FIG. 1 is a schematic view of the apparatus for locating skis beneath snow of this invention, illustrating an audible alarm member as affixed to a snow ski, and a remote trigger or activator member to be carried by the skier.

FIG. 1 is a schematic view of the ski locating apparatus 10 of this invention, illustrating the audible alarm member 12 as affixed to a snow ski S, and a remote trigger or activator member 14 to be carried by the skier. Remote activator member 14 preferably includes two buttons or switches 14*a*, 14*b*, for selective activation of the alarm members of the left and right skis, as described infra. The remote activator member is preferably small in size (e.g., no larger than 1.5 inches wide by 2 inches long by 0.5 inch thick) for ease in carrying by the user, is water resistant, may include a loop for a key chain or wrist strap, and provides for battery replacement.

Figure 2C:
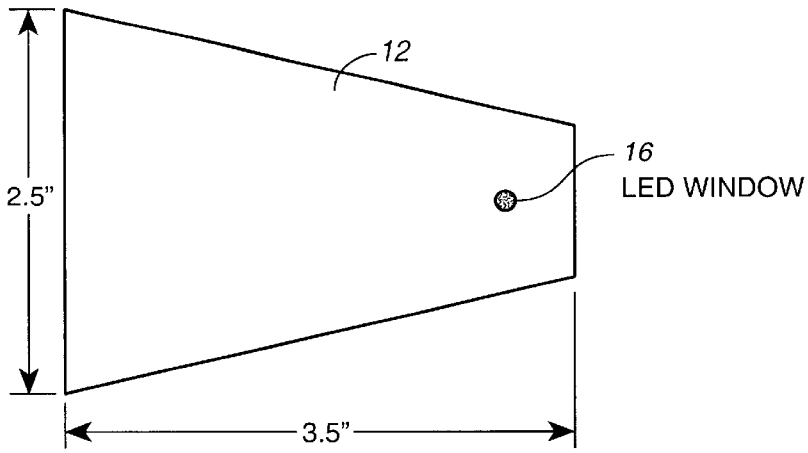
FIGS. 2A–2C are top, side, and front views, respectively, of the alarm member and its outside dimensions.
Figure 2B:
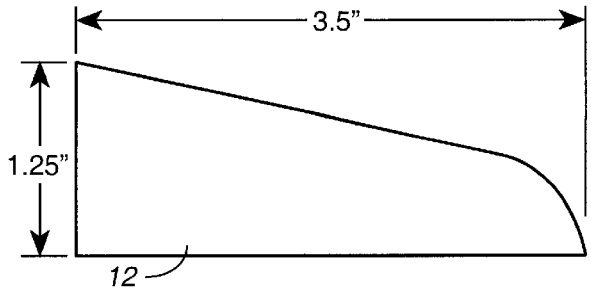
Figure 2A:
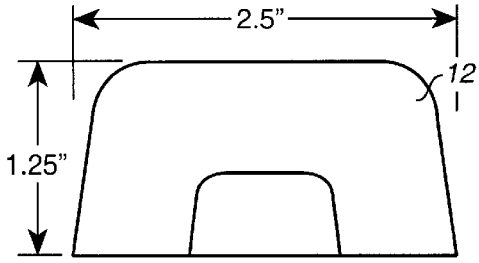

FIGS. 2A–2C are top, side, and front views, respectively, of the alarm member 12 and its outside dimensions. The alarm member is preferably triangular in form (e.g., 3.5–4.0"×2.5"×1.25–1.5" outer dimensions). The alarm member is preferably water resistant and shock resistant, includes battery replacement access, and includes a location 16 for an LED indicator. A printed circuit board is mounted inside the unit, and the unit is detachable from a mounting bracket affixed to ski, as described infra.

Figure 3:
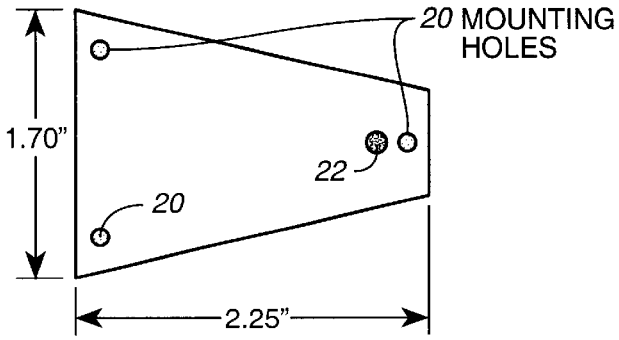
FIG. 3 is a plan view of the alarm member printed circuit board dimensions and mounting hole locations.

FIG. 3 is a plan view of the alarm member 12 printed circuit board 18 preferred dimensions, and mounting hole 20 and LED 22 locations.

Figure 4:
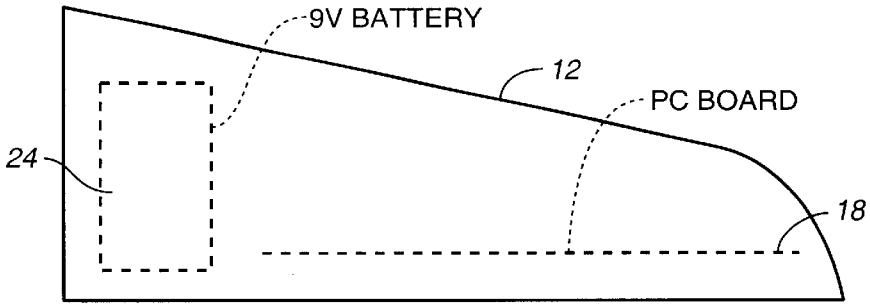
FIG. 4 is a side elevation view of the alarm member illustrating the internal location of the printed circuit board and battery (in phantom)

FIG. 4 is a side elevation view of the alarm member 12 illustrating the preferred internal location of the printed circuit board 18 and battery 24 (illustrated in phantom).

Figure 5:
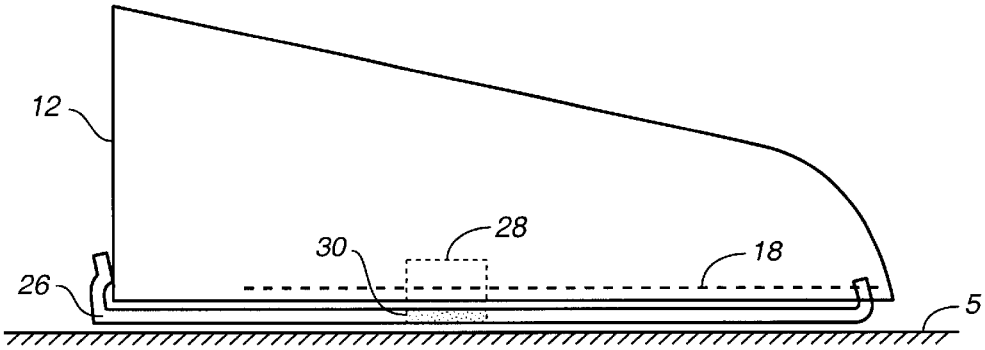
FIG. 5 is a side elevation view of the alarm member as attached to a mounting bracket, which is itself affixed to a ski, this view illustrating a magnetic switch configured for activation of the alarm unit upon placement adjacent to a magnet in the mounting bracket.

FIG. 5 is a side elevation view of the alarm member 12 as attached to a mounting bracket 26, which is itself affixed to ski S, this view illustrating a magnetic switch 28 configured for activation of the alarm unit upon placement adjacent to a magnet 30 in the mounting bracket.

Figure 6:
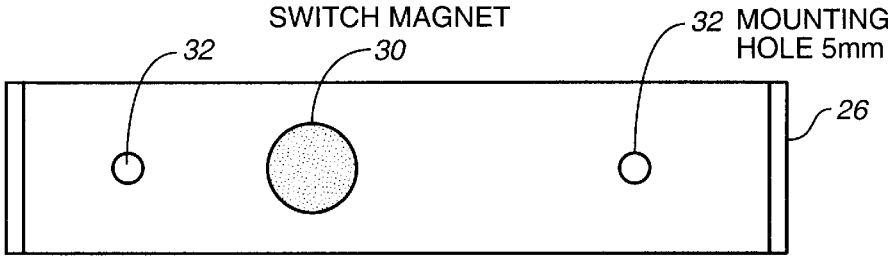
FIG. 6 is a top plan view of the mounting bracket for the alarm member illustrating the switch magnet and mounting holes for the bracket to the ski.

FIG. 6 is a top plan view of the mounting bracket 26 for the alarm member illustrating the switch magnet 30 and mounting holes 32 for affixing the bracket 26 to the ski.

Figure 7:
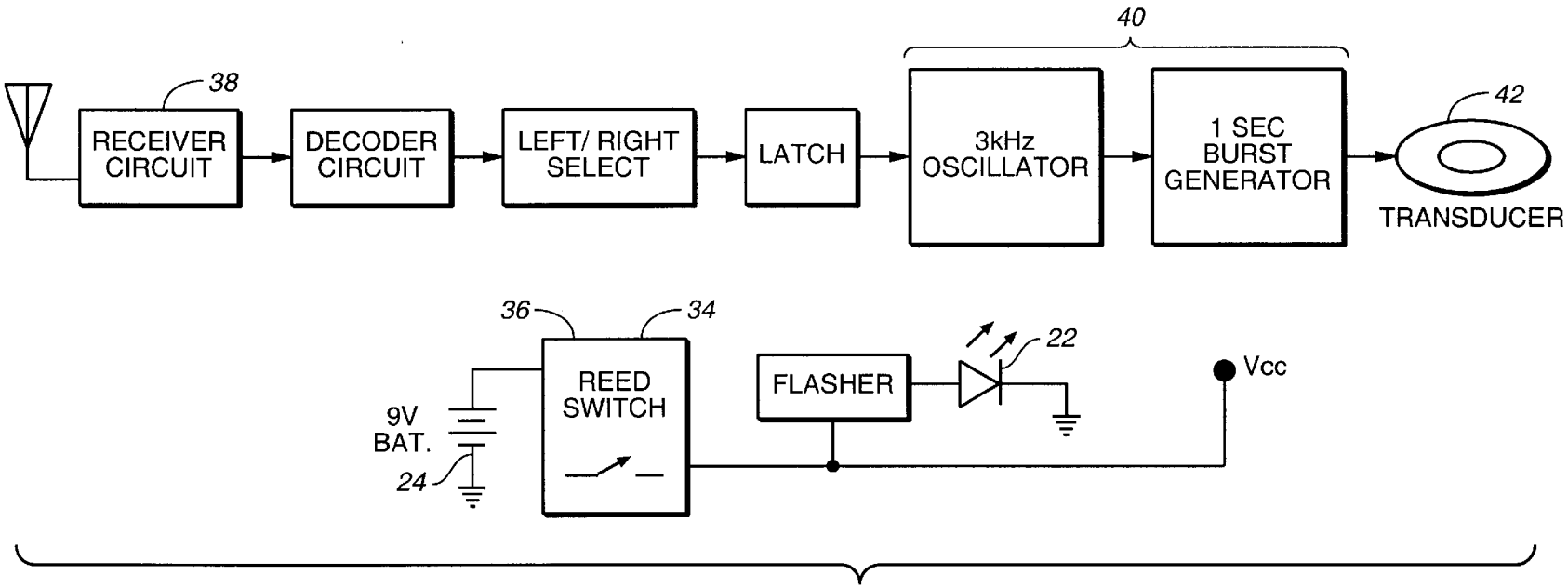
FIG. 7 is a flow chart for the operation of the audible alarm member, illustrating a standby activation portion in the form of a reed switch, a receiver portion, a signal generation portion, and a transducer portion.

FIG. 7 is a flow chart for the operation of the audible alarm member, illustrating a standby activation portion 34 in the form of a reed switch 36, a receiver portion 38, a signal generation portion 40, and a transducer portion 42. The receiver circuit is activated via a magnetically sensitive switch such as reed switch 36 placed on the printed circuit board within the body of the alarm unit. This switch is aligned with the magnet 30 located on the mounting bracket shown in FIGS. 5 and 6, when the alarm member is installed into the mounting bracket.

Figure 8A:
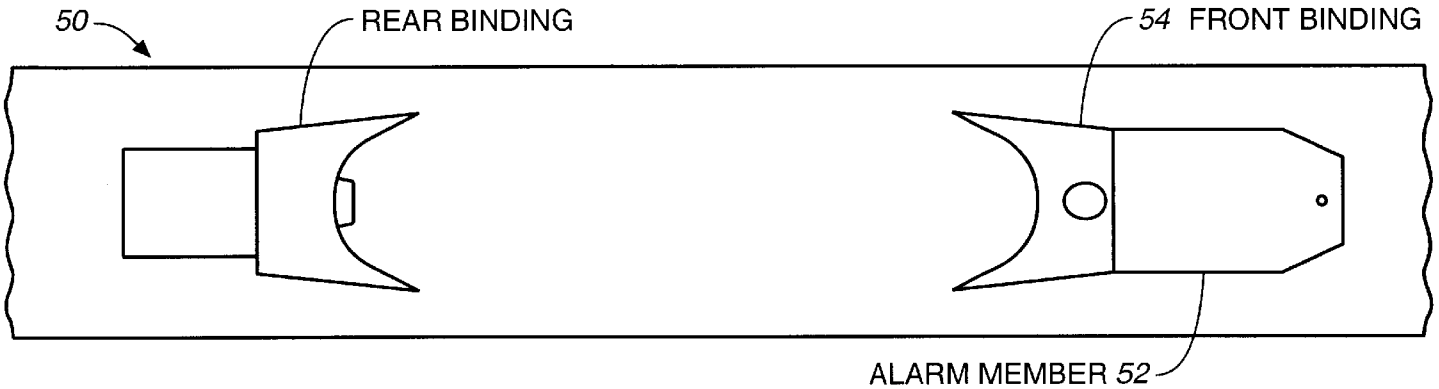
FIG. 8A is a top plan view of a second preferred embodiment of the apparatus for locating skis beneath snow, showing the alarm member incorporated into the toe piece of a ski binding system.
Figure 8B:
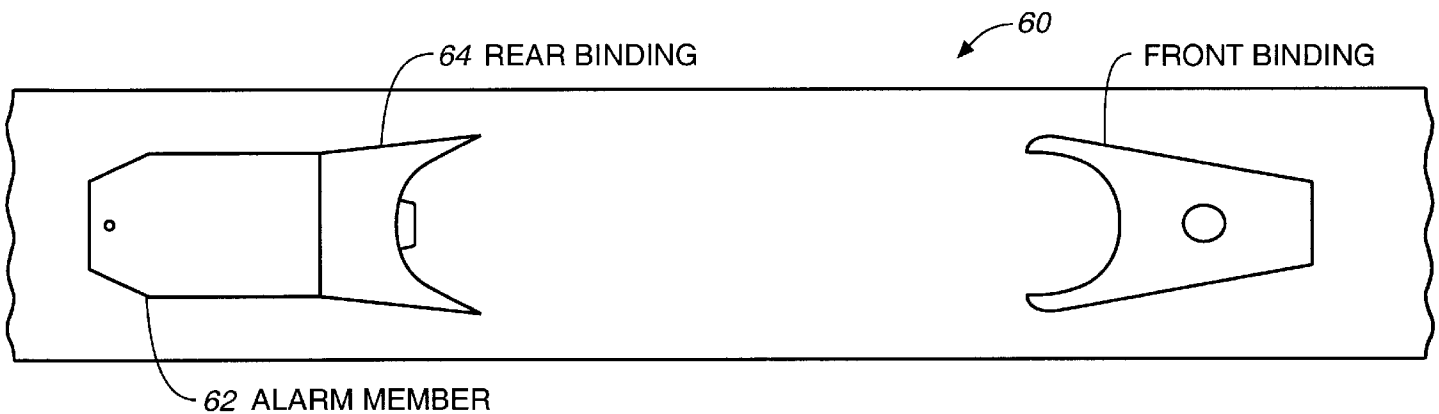
FIG. 8B is a top plan view of a third preferred embodiment of the inventive apparatus, showing the alarm member incorporated into the heel piece of a ski binding system.

FIG. 8A is a top plan view of a second preferred embodiment 50 of the inventive apparatus for locating skis beneath snow, showing the alarm member 52 incorporated into the toe piece 54 of a ski binding system. FIG. 8B shows a third preferred embodiment 60 wherein the alarm member 62 is incorporated into the heel piece 64 of a ski binding system.

Typical specifications for the inventive system may include the following:

RF Specifications:

a) frequency range: unspecified.
b) distance range: more than 15 meters with receiver under 1 meter of loose snow.
c) number of channels: two channels; set by different frequencies or different codes on carrier.
d) comply with applicable USA and European regulations for unlicensed transceivers.

Electrical Specifications:

a) transmitter power supply: hearing aid-type batteries.
b) receiver power supply: 9v battery.
c) receiver power consumption; less than 8 mA in the stand-by mode, less than 50 mA average in the on mode.
d) operating temperature range: −30° C. to +40° C.

Electro-Acoustic Specifications a) acoustic signal frequency: 3000 Hz±100 Hz.
b) acoustic signal level: ≧92 dB SPL @ 1 meter anechoic.
c) acoustic signal character: periodic bursts: 1 second ON/1 second OFF.
d) radiation characteristics: directivity index ≦7 dB (radiation axis perpendicular to mounting plane of acoustic transducer). No significant lobes or nulls within the main radiation area.
e) acoustic signal output: The alarm units are specified to be water resistant, therefore a special arrangement for the radiation of the acoustic signal from the transducer should be implemented. This arrangement will allow water rejection while allowing sonic pressure to radiate from the transducer. Methods include a thin membrane area over the transducer, a microfiber (such as GoreTex) that allows air to pass but not water, or any other that meets the requirements.

It is recommended that the acoustic transducer be a Piezo-Electric type. This transducer should be mounted in a resonant cavity with resonant frequency of 3,000 Hz to optimize efficiency. A model that is known to meet these specifications is the Kingstate Electronics Corp. KB1-3529F-W100.

Functional Specifications:

a) trigger modes: The remote trigger control (activator member) should incorporate two momentary switches. Each press of a switch changes the status of the respective receiver-alarm unit from Stand-by to On to Stand-by. The two switches should be able to switch on the two receivers individually or simultaneously. This left/right ski discrimination prevents location confusion from having both skis put out a locating alarm. This is accomplished by having a two button remote or one button that cycles through Off-Left-Right-Off-etc. Each trigger sends a different enable signal to each ski (e.g., different frequencies or channels), so that they only turn on one at a time. In addition, two different complete ski finder units will not set each other off when triggered. The unit should allow for at least eight different user codes.
b) alarm unit enabling: The alarm units should be disabled (i.e., no power to circuits) when the alarm units are removed from their mounting brackets. When placed in the mounting brackets, the alarm units then switch to the stand-by mode, through the reed switch 36 being activated by the magnet 30 on the mounting bracket. In the stand-by mode the alarm unit receiver, decoder and latch circuits are enabled, but the oscillator and burst generators are disabled. Once switched to ON mode by the remote trigger signal, all the circuits in the alarm unit are enabled. Thus, the user no longer has to remember to turn the unit on and off. Simply placing the unit onto its bracket will turn it on; removing it will turn it off. Additionally, this makes the unit more waterproof as there are no mechanical switches, shown in prior art, to seal off from water.
c. Blinking Power Indicator: The ski alarm can incorporate a power ON indicator. The current state of the art is to include an LED type indicator. These typically consume about 10 mA to give out sufficient light to be seen on a bright day. The ski finder circuitry in stand-by mode consumes about 5 mA, so the power indicator will use up too much battery power, compared to the rest of the device. The solution is to have a blinking LED with a short duty cycle. One duty cycle time that works well for visibility and battery life is 100 ms On/2 seconds off. This gives a very short duty time, 100 ms/200 ms=0.05, thereby using only 5% of the aforementioned 15 mA, being equivalent over time to a 0.75 mA load. Circuits enabling such blinking characteristics are well known in the art.

d. Battery Voltage: An additional feature of the ski finder can be to make the aforementioned power indicator also indicate battery voltage status. The indicator can be visible as long as the battery voltage is in a useful range, and can then extinguish below that range, even though the power is still on. This feature allows the user to know when to replace the battery. For example, the incorporation of a Zener diode in series with the LED creates the illumination range feature. A choice of Zener breakdown voltage will adjust the illumination range. For this embodiment using a 9 volt battery the extinction voltage was set to 7 volts.

e. Resonator Chamber: the alarm transducer can be placed in a resonator cavity to increase its sound pressure level. For example, with the transducer described above, and a frequency around 3 kHz, a resonator cavity may have the following dimensions: height 0.57 cm., diameter 2.12 cm., and output port diameter 0.7 cm.

Thus, the preferred embodiment of the apparatus for locating skis beneath snow of this invention provides a system including at least one audible alarm member adapted for releasable attachment to a ski, and including a receiver portion connected to a signal generator portion and a transducer portion, with a remote activator member adapted for selective activation by a user, the remote activator member including a transmitter and a switch for activating the transmitter. When the switch activates the transmitter, the receiver portion activates the signal generator portion and the transducer portion to emit an audible sound to assist in the location of the ski. As indicated, supra, the alarm member may be permanently attached to a ski, for example, by being incorporated into a ski binding system.

The apparatus may further include an alarm member mounting bracket having a magnet, and where the alarm member has on an off mode, a standby mode, and an on mode, and includes a standby switch responsive to the mounting bracket magnet, wherein when the alarm member is placed into the mounting bracket, the standby switch is activated the alarm member enters the standby mode.

The apparatus may further include an indicator which illuminates when the alarm member is activated. The indicator may consist of a blinking LED having a duty cycle, illuminating for a first time period T1 and not illuminating for a second time period T2, wherein T1 is less than T2, in order to conserve battery power and extend battery life. The LED may further be adapted to illuminate only when battery voltage exceeds a predetermined level.

The apparatus may further be characterized as having an alarm member with an off mode, a standby mode, and an on mode, wherein the alarm member is adapted to be in the off mode when the alarm member is not attached to the ski, in standby mode when the alarm member is attached to the ski and the activator member switch is not activating the transmitter, and in on mode when the alarm member is attached to the ski and the activator member switch is activating the transmitter, further reducing power consumption. In this configuration, when the alarm member is in the off mode the receiver portion, signal generator portion, and transducer portion are inactive; when the alarm member is in standby mode the receiver portion is active and the signal generator portion and transducer portion are inactive, and when the alarm member is in the on mode the receiver portion, signal generator portion and transducer portion are active.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and their legal equivalents.

What is claimed as invention is:

1. An apparatus for locating skis beneath snow, said apparatus comprising:

an audible alarm member adapted for attachment to a ski, said audible alarm member including a receiver portion connected to a signal generator portion and a transducer portion; and a remote activator member adapted for selective activation by a user, said remote activator member including a transmitter and a switch for activating said transmitter, wherein when said switch activates said transmitter, said receiver portion activates said signal generator portion and said transducer portion to emit an audible sound to assist in the location of the ski.

2. The apparatus for locating skis beneath snow of claim 1 wherein said audible alarm portion is releasably attached to the ski.

3. The apparatus for locating skis beneath snow of claim 1 wherein said alarm member is attached to a ski with a mounting bracket.

4. The apparatus for locating skis beneath snow of claim 3 wherein said mounting bracket includes a magnet, and said alarm member has on an off mode, a standby mode, and an on mode, and includes a standby switch responsive to said mounting bracket magnet, wherein when said alarm member is placed into said mounting bracket, said standby switch is activated and said alarm member enters said standby mode.

5. The apparatus for locating skis beneath snow of claim 1 wherein said alarm member includes an indicator which illuminates when said alarm member is activated.

6. The apparatus for locating skis beneath snow of claim 5 wherein said indicator comprises a blinking LED having a duty cycle, illuminating for a first time period T1 and not illuminating for a second time period T2, wherein T1 is less than T2.

7. The apparatus for locating skis beneath snow of claim 5 wherein said alarm member includes a battery, and said indicator comprises an LED adapted to illuminate only when battery voltage exceeds a predetermined level.

8. The apparatus for locating skis beneath snow of claim 1 wherein said alarm member has on an off mode, a standby mode, and an on mode, and wherein said alarm member is adapted to be in said off mode when said alarm member is not attached to the ski, is in standby mode when said alarm member is attached to the ski and said activator member switch is not activating said transmitter, and is in on mode when said alarm member is attached to the ski and said activator member switch is activating said transmitter.

9. The apparatus for locating skis beneath snow of claim 8 wherein said alarm member is in said off mode said receiver portion, signal generator portion, and said transducer portion are inactive; when said alarm member is in standby mode said receiver portion is active and said signal generator portion and said transducer portion are inactive; and when said alarm member is in said on mode said receiver portion, said signal generator portion and said transducer portion are active.

10. The apparatus for locating skis beneath snow of claim 1 wherein said alarm member transducer portion includes a resonator cavity.

11. The apparatus for locating skis beneath snow of claim 1 wherein said remote activator member includes two separate transmission channels.

12. The apparatus for locating skis beneath snow of claim 11 wherein said remote activator member includes a pair of switches to operate said two separate transmission channels.

13. The apparatus for locating skis beneath snow of claim 12 wherein said pair of switches comprise momentary switches.

14. The apparatus for locating skis beneath snow of claim 12 further including a pair of audible alarm members attached to separate skis, wherein each of said alarm members is responsive to a separate transmission channel.

15. The apparatus for locating skis beneath snow of claim 1 wherein said remote activator member includes a plurality of transmission codes.

16. The apparatus for locating skis beneath snow of claim 1 wherein said alarm member is incorporated into a ski binding system.

17. The apparatus for locating skis beneath snow of claim 16, wherein said alarm member is incorporated into the toe member of the ski binding system.

18. The apparatus for locating skis beneath snow of claim 16 wherein said alarm member is incorporated into the heel member of the ski binding system.

* * * * *